US010444707B2

(12) United States Patent
Hernandez et al.

(10) Patent No.: US 10,444,707 B2
(45) Date of Patent: Oct. 15, 2019

(54) BALANCE-SPRING INTENDED TO BE SECURED BY A RESILIENT WASHER

(71) Applicant: Nivarox-FAR S.A., Le Locle (CH)

(72) Inventors: Ivan Hernandez, Cressier (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/725,392

(22) Filed: Oct. 5, 2017

(65) Prior Publication Data

US 2018/0107162 A1 Apr. 19, 2018

(30) Foreign Application Priority Data

Oct. 13, 2016 (EP) ..... 16193768

(51) Int. Cl.
*G04B 17/06* (2006.01)
*G04B 17/34* (2006.01)

(52) U.S. Cl.
CPC ..... *G04B 17/345* (2013.01); *G04B 17/06* (2013.01)

(58) Field of Classification Search
CPC ..... G04B 17/06; G04B 43/002; G04B 43/00; G04B 17/32; G04B 17/325; G04B 17/34; G04B 17/345
See application file for complete search history.

(56) References Cited

U.S. PATENT DOCUMENTS

| | | | | |
|---|---|---|---|---|
| 3,430,435 | A * | 3/1969 | Dumont | G04B 17/345 368/177 |
| 7,213,966 | B2 * | 5/2007 | Lambert | G04B 17/34 368/175 |
| 9,411,312 | B2 * | 8/2016 | Wang | G04D 3/0041 |
| 9,411,314 | B2 * | 8/2016 | Daout | G04B 17/345 |
| 9,645,549 | B2 * | 5/2017 | Conus | G04B 17/066 |
| 9,671,756 | B2 * | 6/2017 | Stranczl | G04B 17/325 |
| 9,983,548 | B2 * | 5/2018 | Stranczl | G04B 17/32 |
| 2005/0219957 | A1 * | 10/2005 | Lambert | G04B 17/34 368/177 |
| 2009/0135679 | A1 | 5/2009 | Musy et al. | |
| 2015/0253733 | A1 | 9/2015 | Stranczl | |
| 2015/0286188 | A1 * | 10/2015 | Dubois | G04B 13/022 368/322 |
| 2016/0299470 | A1 * | 10/2016 | Conus | G04B 17/066 |
| 2017/0017204 | A1 * | 1/2017 | Stranczl | G04B 17/34 |
| 2019/0049900 | A1 * | 2/2019 | Bucaille | G04D 7/08 |

FOREIGN PATENT DOCUMENTS

| | | |
|---|---|---|
| EP | 1 857 891 A1 | 11/2007 |
| EP | 2 916 177 A1 | 9/2015 |

OTHER PUBLICATIONS

European Search Report dated Apr. 11, 2017 in European Application 16193768.5, filed Oct. 13, 2016 (with English Translation of Categories of Cited Documents).

* cited by examiner

*Primary Examiner* — Sean P Kayes
(74) *Attorney, Agent, or Firm* — Oblon, McClelland, Maier & Neustadt, L.L.P.

(57) ABSTRACT

A collet elastically mounted on a staff whose geometry produces fewer internal stresses in particular on the contact points and the vertices of its polygonal shape.

8 Claims, 5 Drawing Sheets

BALANCE-SPRING INTENDED TO BE SECURED BY A RESILIENT WASHER

This application claims priority from European Patent Application No. 16193768.5 filed on Oct. 13, 2016; the entire disclosure of which is incorporated herein by reference.

FIELD OF THE INVENTION

The invention relates to a balance-spring intended to be elastically fixed by a washer. More precisely, the invention relates to a collet devised to fix a balance-spring to a staff using the elastic clamping of a washer.

BACKGROUND OF THE INVENTION

EP Patent 2916177 in the name of the Applicant discloses such a collet without recourse to adhesive or soldering. Said collet advantageously makes it possible to avoid shifting the point of attachment when the collet is received on the staff, to position the centre of gravity on the geometric centre of the strip and also to limit material breakage caused by the washer clamping the surface of the collet.

However, on applying the Von Mises criterion, it emerged that the collet is subjected to large variations in stress along its polygonal-shaped strip. Indeed, high contact stresses are generated at the points of contact with the staff, accompanied by bending stresses at the vertices of said polygon.

SUMMARY OF THE INVENTION

It is an object of the invention to overcome all or part of the aforementioned drawbacks by proposing a collet that maintains the advantages of EP Patent Application 2916177 while generating fewer contact and bending stresses in the strip and, in particular, at the contact points and vertices of said polygon.

To this end, the invention relates to a balance-spring comprising a spiral spring formed of a strip wound on itself in several coils and a collet including a strip extending substantially in the form of a triangle, the strip comprising, at each of the vertices of said triangle, a bulge extending radially towards the inner coil of the spring, the point of attachment between the spring and the collet being located on one of the bulges of said triangle which is symmetrical with respect to the staff passing through the centre of the collet and said point of attachment, characterized in that the strip, between each of the vertices of said triangle, is formed of first and second areas of substantially constant widths and of a third area, between the first and second areas, which has a thicker width compared to those of the first and second areas and which is arranged to be fitted onto a staff in order to shift the elastic deformation stresses on the first and second two areas.

Surprisingly, by shifting the areas of elasticity between the points of contact between the staff and said polygon vertices of the collet, it was possible to reduce the contact stresses by 70% and, the bending stresses by 40% compared to those of the collet of FIG. 9 of EP Patent Application 2916177. It is therefore clear that the internal stresses are much lower within the collet. Further, during fitting, it was possible to better balance the contact stresses while maintaining a minimum retaining clamping torque on the staff.

In accordance with other advantageous variants of the invention:

the first and second areas have identical widths;

the length of the third area represents between 20% and 50% of the total length of the three areas;

the width of the third area represents between 140% and 300% of the width of the first and second areas;

the third area thickens as it extends radially towards the centre of the collet;

the third area thickens as it extends radially towards the inner coil of the spring;

the third area thickens as it extends radially towards the centre of the collet and towards the inner coil of the spring;

the spring is formed from silicon.

Moreover, the invention relates to a resonator for a timepiece, characterized in that it includes a staff on which there is fitted a balance and a balance-spring according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The invention relates to a balance-spring intended to be elastically fixed by a washer. More precisely, the invention relates to a collet devised to fix a balance-spring to a staff using the elastic clamping of a washer.

This assembly system is described in EP Patent Applications 2860591 and 2860592 in the name of the Applicant and incorporated by reference in the present description. This assembly system offers a great deal of freedom as to the materials used. It is thus particularly applicable for a part whose material has no usable plastic domain, i.e. with a very limited plastic domain, with a member comprising a different type of material.

In the field of horology, this type of assembly allowing a great deal of freedom as to the materials used must henceforth be proposed due to the increasing share of materials having a very restricted plastic domain such as those of silicon-based materials such as doped or undoped single crystal (or polycrystalline) silicon, silicon oxide, such as quartz or silica, single crystal or polycrystalline corundum or more generally alumina, silicon nitride and silicon carbide.

Figure 1:
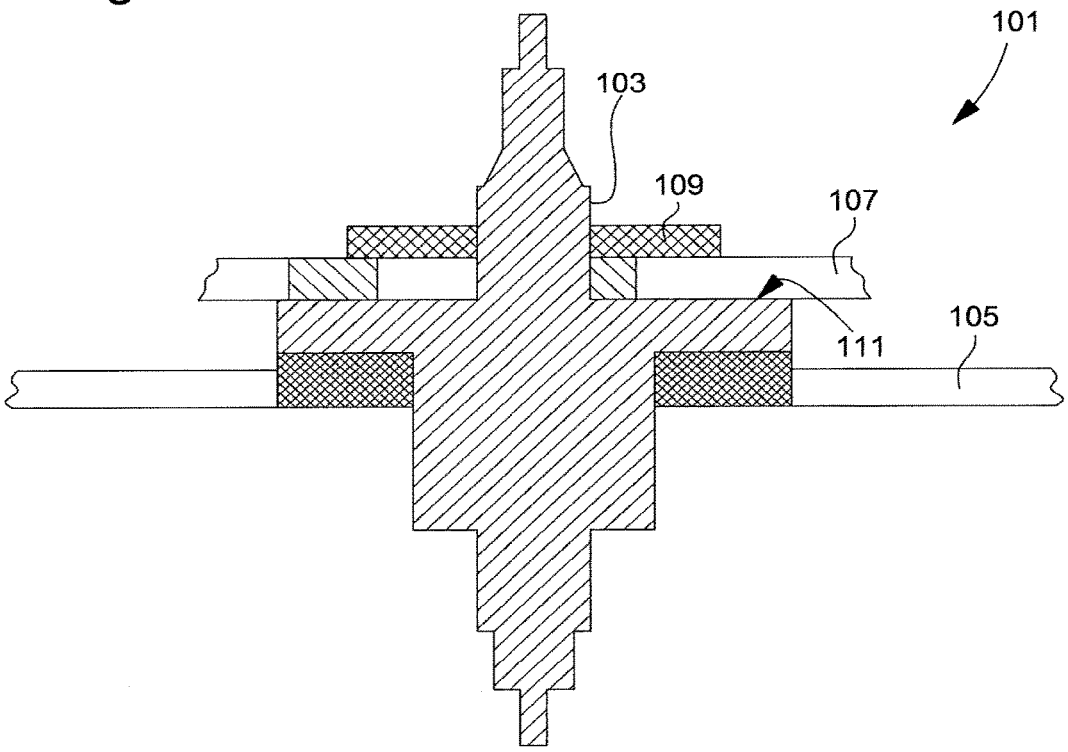
FIG. 1 is a representation of a type of assembly according to the invention.

An example of this type of assembly is presented in FIG. 1. Resonator 101 for a timepiece comprises a staff 103 onto which is fitted a balance 105 and a balance-spring 107 which may advantageously be a balance-spring 1, 21, 41 described in the present Application. In the example of FIG. 1, the collet of balance-spring 107 is elastically fitted onto staff 103 between a washer 109 and a shoulder 111 of staff 103. As explained in EP Patent Applications 2860591 and 2860592, washer 109 grips, mainly on the peripheral part thereof, the collet of balance-spring 107 by elastic clamping.

The collet presented in FIG. 9 of EP Patent 2916177 includes a strip 67, extending in the form of a triangle, devised for this type of assembly described in EP Patent Applications 2860591 and 2860592. Between each of the vertices of said triangle, strip 67 has a non-constant width. More precisely, strip 67, between each of the vertices of said triangle, changes from a maximum width at the clamping points gradually decreasing towards the vertices on two of the arms and a third arm with a fourth bulge allowing the centre of gravity to be positioned on the geometrical centre of the strip.

On applying the Von Mises criterion, it emerged that collet 65 of EP Patent Application 2916177 is subjected to large variations in stress along its strip 67 for a gripping of 6 μm in diameter. Indeed, the contact stresses at the points of contact with the staff are comprised between 300 and 450 MPa and the bending stresses are between 500 and 600 MPa at the vertices of the triangle, whereas they are virtually zero between said contact points and said vertices. Although these maximum values are not in themselves disadvantageous for most of the materials used in horology, the collet is nonetheless subjected to large variations in stress along its strip. This is why the present Application proposes to limit the variations in stress along the strip, and particularly at the contact points.

Surprisingly, it was found that simply by adapting the geometry of the collet arms, it is possible to drastically decrease the contact stress applied to the points of contact with the staff and also to limit the maximum bending stresses observed along the strip while still enjoying the advantages of EP Application 2916177 and maintaining the minimum retaining clamping torque on the staff.

According to the invention, balance-spring 1, 21, 41 thus includes a spiral spring 3 comprising a strip wound on itself in several coils and a collet 5, 25, 45 including a strip 7, 27, 47 extending substantially in the form of a triangle. Strip 7, 27, 47 includes, at each of the vertices of said triangle, a bulge 2, 4, 8, 22, 24, 28, 42, 44, 48 extending radially towards the inner coil $S_I$ of spring 3. Finally, the point of attachment between spring 3 and collet 5, 25, 45 is located on one of the bulges 2, 22, 42 of said triangle, which is symmetrical with respect to the axis passing through the centre C of the collet and said point of attachment. Centre C may be defined as the centre of the circle inscribed within the opening of collet 5, 25, 45.

It is proposed to adapt the geometry of the arms of collet 5, 25, 45, i.e. parts of strip 7, 27, 47 between the vertices of the triangle, by shifting the areas of elasticity, i.e. the flexible areas, between the points of contact $P_1$, $P_2$, $P_3$ between staff A and the vertices of said triangle of collet 5, 25, 45.

Thus, advantageously according to the invention, between each of the vertices of said triangle, strip 7, 27, 47 is formed of first and second areas $Z_{1x}$, $Z_{2x}$ of substantially constant width and of a third area $Z_{3x}$, $Z_{4x}$, $Z_{5x}$, between first and second areas $Z_{1x}$, $Z_{2x}$, which has a thickened width compared to those of first and second areas $Z_{1x}$, $Z_{2x}$, and which is arranged to be fitted on a staff A allowing the elastic deformation forces on first and second areas $Z_{1x}$, $Z_{2x}$ of strip 7, 27, 47 to be shifted.

On applying Von Mises criterion again, it emerged, surprisingly, that the collet 5, 25, 45 of the present Application is subjected to lower variations in stress along its strip 7, 27, 47 compared to those of EP Patent Application 2916177. Indeed, for an identical desired gripping of 6 μm, the contact stresses at the points of contact $P_1$, $P_2$, $P_3$ with staff A are all around 100 MPa and the bending stresses do not exceed 400 MPa along strip 7, 27, 47.

It is perhaps most surprising that the contact stresses are also reduced at contact point $P_2$ although the fourth bulge 6, 26, 46 could already be considered to be a thickened portion of strip 7, 27, 47 on one of the arms of collet 5, 25, 45. It therefore seems that the geometry of the three areas $Z_{1x}$, $Z_{2x}$, $Z_{3x}$, $Z_{4x}$, $Z_{5x}$, on each of the arms must be substantially identical and respect a certain shape for the bending and contact stresses to be better balanced and lower within collet 5, 25, 45.

To obtain these results, first and second areas $Z_{1x}$, $Z_{2x}$ were kept with preferably identical lengths $L_{13}$, $L_{23}$, $L_{1x}$, $L_{2x}$, heights and widths $W_{13}$, $W_{23}$, $W_{1x}$, $W_{2x}$. Further, it became clear that a length of the third area $Z_{3x}$, $Z_{4x}$, $Z_{5x}$ comprised between 20% and 50% of the total length of the three areas $Z_2$x, $Z_3$x, $Z_{4x}$, $Z_{5x}$, and a width of third area $Z_{3x}$, $Z_{4x}$, $Z_{5x}$ representing between 140% and 300% of the width $W_{1x}$, $W_{2x}$ of the first and second areas $Z_{1x}$, $Z_{2x}$ make it possible to maintain the above advantages.

Figure 5:
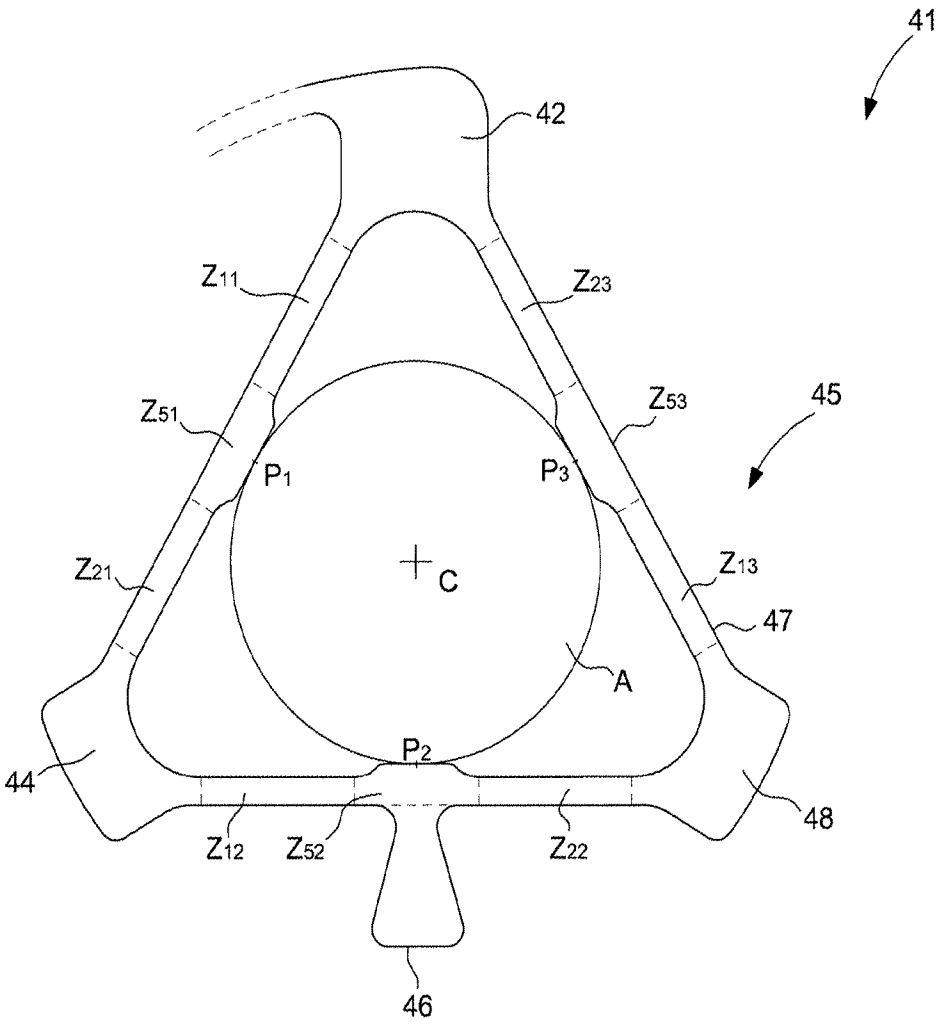
FIG. 5 is a representation of a third embodiment of the invention.

Three example applications of the invention are presented below, maintaining the height and with variations in the length and width of the third area $Z_{3x}$, $Z_{4x}$, $Z_{5x}$. Thus, according to a first embodiment presented in FIG. 5, balance-spring 4 includes a collet 45 with a strip 47 that includes three thickened areas $Z_{51}$, $Z_{52}$, $Z_{53}$ which each extend radially towards the centre C of collet 45. It can be observed that each third area $Z_{51}$, $Z_{52}$, $Z_{53}$ offers a substantially plane surface for the contact point $P_1$, $P_2$, $P_3$ with staff A.

The first and second areas $Z_{1x}$, $Z_{2x}$ of each arm of strip 47 form right rectangular prisms that are all identical and offer an identical elastic character to each other. A length of the third area $Z_{51}$, $Z_{52}$, $Z_{53}$ substantially equal to 20% of the total length of the three areas $Z_{51}$, $Z_{52}$, $Z_{53}$, and a width of third area $Z_{51}$, $Z_{52}$, $Z_{53}$ substantially equal to 143% of the width $W_{1x}$, $W_{2x}$ of the first and second areas $Z_{1x}$, $Z_{2x}$ are applied in the first embodiment of FIG. 5. It can also be seen that between the substantially constant width on the substantially plane surface for contact point $P_1$, $P_2$, $P_3$ with staff A and the widths of the first and second areas $Z_{1x}$, $Z_{2x}$, third area $Z_{51}$, $Z_{52}$, $Z_{53}$ decreases in width along a radius, i.e. gradually.

Finally, it is seen that a fourth bulge 46 extending radially towards the inner coil is present on third area $Z_{52}$ of the arm opposite to bulge 42 in order to position the centre of gravity of collet 45 at centre C of collet 45.

Figure 4:
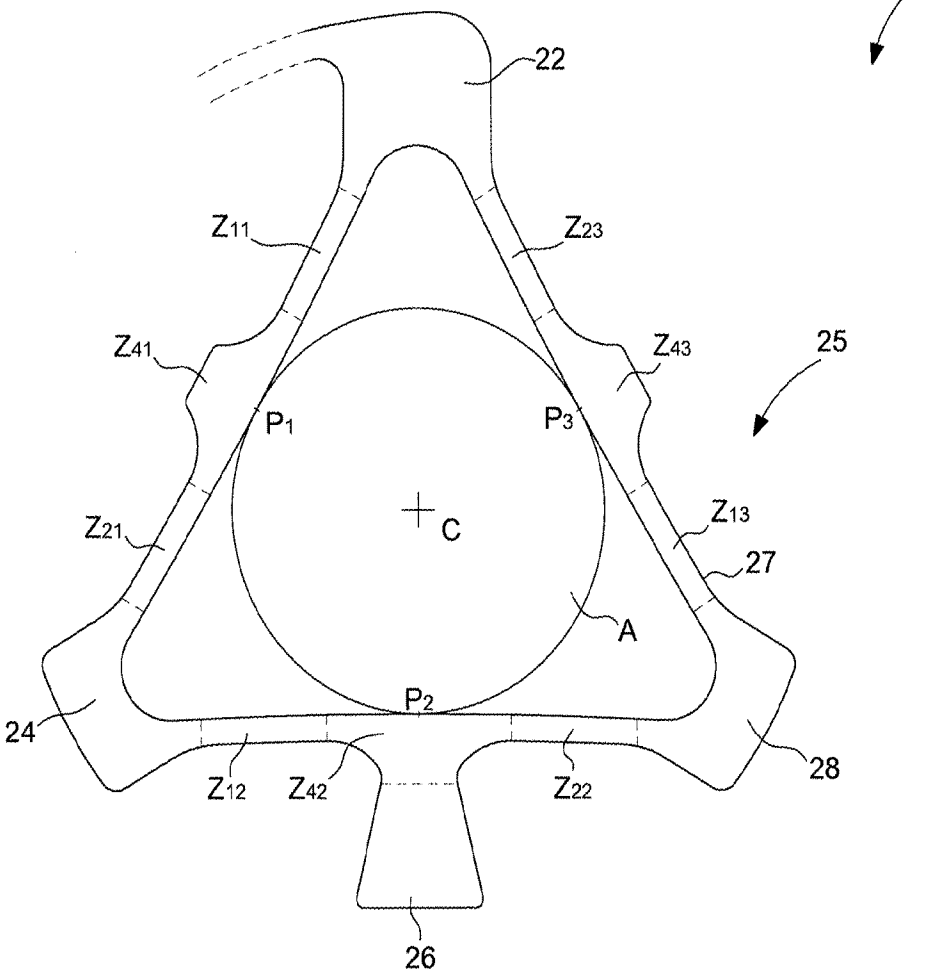
FIG. 4 is a representation of a second embodiment of the invention.

According to a second embodiment presented in FIG. 4, balance-spring 21 includes a collet 25 with a strip 27 which includes three thickened third areas $Z_{41}$, $Z_{42}$, $Z_{43}$ which each extend radially towards the inner coil of the spring. It can be observed that each third area $Z_{41}$, $Z_{42}$, $Z_{43}$ offers, for point of contact $P_1$, $P_2$, $P_3$ with staff A, a substantially plane surface in the extension of the adjacent first and second areas $Z_{1x}$, $Z_{2x}$.

The first and second areas $Z_{1x}$, $Z_{2x}$ of each arm of strip 27 form right rectangular prisms that are all identical and offer an identical elastic character to each other. A length of third area $Z_{41}$, $Z_{42}$, $Z_{43}$ substantially equal to 42% of the total length of third areas $Z_{1x}$, $Z_2$x, $Z_{4x}$, and a width of third area $Z_{41}$, $Z_{42}$, $Z_{43}$ substantially equal to 267% of the width $W_{1x}$, $W_{2x}$ of the first and second areas $Z_{1x}$, $Z_{2x}$ are applied in the second embodiment of FIG. 4. It can also be seen that between the substantially constant width on the substantially plane surface for contact point $P_1$, $P_2$, $P_3$ with staff A and the widths of the first and second areas $Z_{1x}$, $Z_{2x}$, third area $Z_{41}$, $Z_{42}$, $Z_{43}$ decreases in width along a radius, i.e. gradually.

Finally, it is seen that a fourth bulge 26 extending radially towards the inner coil is present in the extension of third area $Z_{42}$ of the arm opposite to bulge 22 in order to position the centre of gravity of collet 25 at centre C of collet 25. Further, it can be seen that, proportionally, the fourth bulge 26 of the second embodiment is more voluminous than that 46 of the first embodiment.

Figure 2:
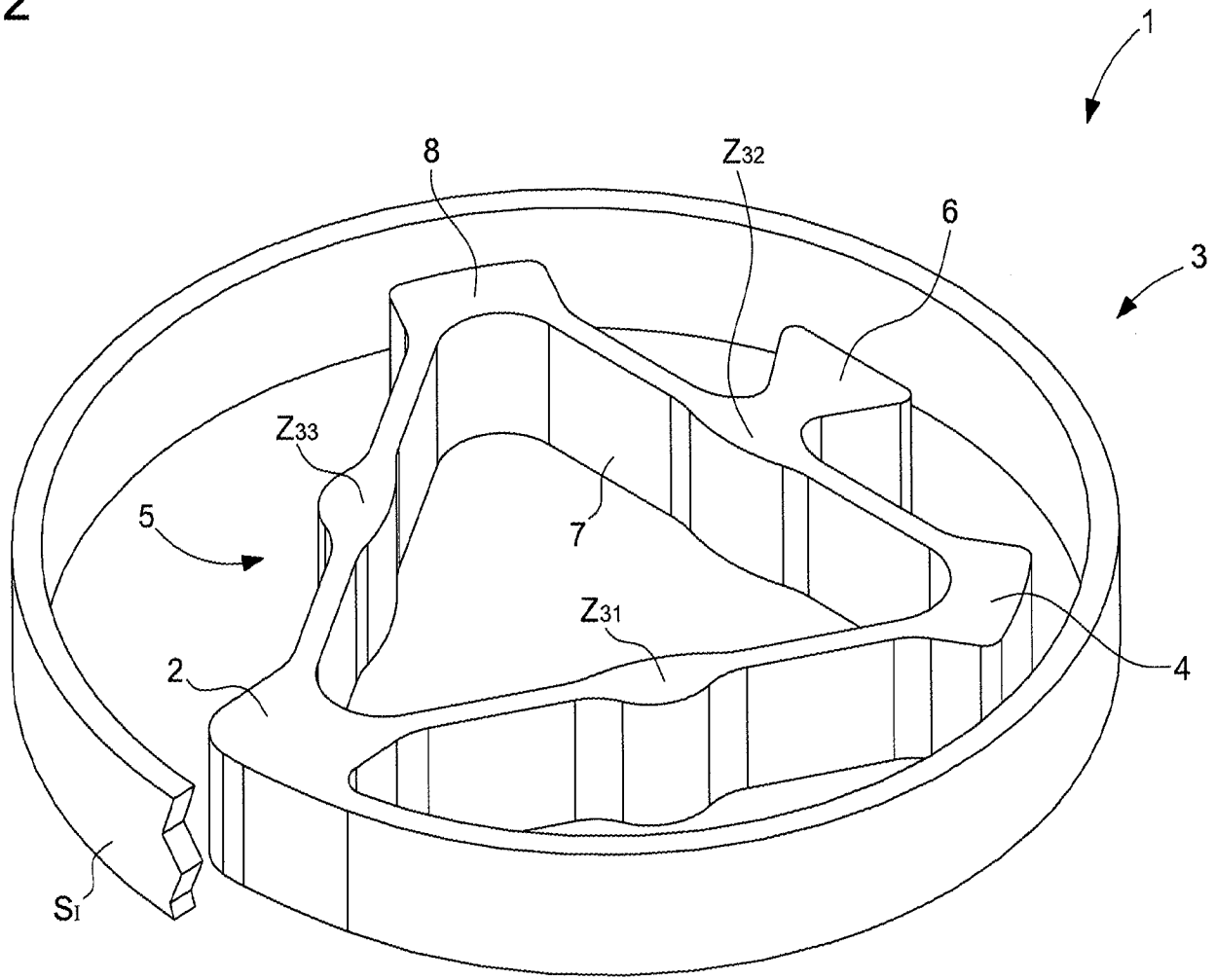
FIGS. 2 and 3 are representations of a first embodiment of a collet according to the invention.
Figure 3:
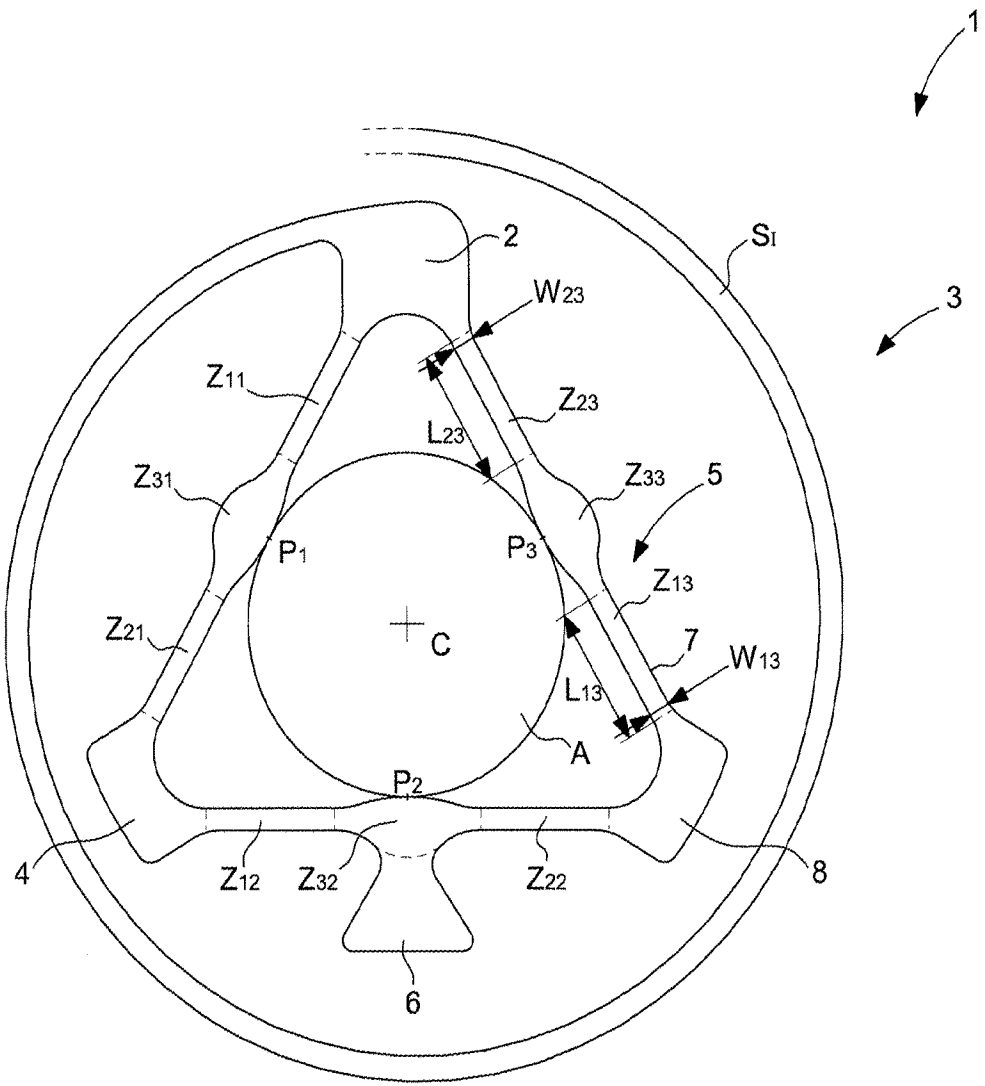

According to a third embodiment presented in FIGS. 2 and 3, balance-spring 1 includes a collet 5 with a strip 7 which includes three thickened areas $Z_{31}$, $Z_{32}$, $Z_{33}$ which each extend radially towards centre C of collet 5 and towards inner coil $S_I$ of spring 3. The third embodiment can therefore be considered a mixture of the first and second embodiments. However, in the third embodiment, it is seen that each third area $Z_{31}$, $Z_{32}$, $Z_{33}$ offers a substantially concave surface for the point of contact $P_1$, $P_2$, $P_3$ with staff A.

The first and second areas $Z_{1x}$, $Z_{2x}$ of each arm of strip 7 form right rectangular prisms that are all identical and offer an identical elastic character to each other. A length of the third area $Z_{31}$, $Z_{32}$, $Z_{33}$ substantially equal to 38% of the total length of the three areas $Z_{31}$, $Z_{32}$, $Z_{33}$, and a width of third area $Z_{51}$, $Z_{52}$, $Z_{53}$ substantially equal to 167% of the width $W_{1x}$, $W_2x$ of the first and second areas $Z_{1x}$, $Z_{2x}$ are applied in the third embodiment of FIGS. 2 and 3. More precisely, an increased thickness of 50% is applied radially towards centre C of collet 5 and of 117% towards inner coil $S_I$ of spring 3. It can also be seen that between the maximum width on contact point $P_1$, $P_2$, $P_3$ with staff A and the widths of the first and second areas $Z_{1x}$, $Z_{2x}$, third area $Z_{31}$, $Z_{32}$, $Z_{33}$ decreases in width along two distinct radii, i.e. gradually on the inner and outer faces of each arm.

Finally, it is seen that a fourth bulge 6 extending radially towards inner coil $S_I$ is present in the extension of third area $Z_{32}$ of the arm opposite to bulge 2 in order to position the centre of gravity of collet 5 at centre C of collet 5.

Of course, the present invention is not limited to the illustrated example but is capable of various variants and modifications that will appear to those skilled in the art. In particular, the three embodiments can be combined with each other without departing from the scope of the invention. Thus, by way of example, the surfaces on point of contact $P_1$, $P_2$, $P_3$ with staff A could be switched between the first and third embodiments. It is thus clear that the surfaces on contact point $P_1$, $P_2$, $P_3$ may be plane, convex or concave without departing from the scope of the invention.

Further, collet 5, 25, 45 according to the invention is not limited to a triangular-shaped strip 7, 27, 47. The invention may also be applied to a different type of polygon.

Balance-spring 1, 21, 41 may also be formed using several materials. Thus, in a non-limiting manner, the base material, such as for example silicon, could receive a complete or partial coating composed of a temperature compensating layer and/or a layer that is resistant and impermeable to moisture so as to make balance-spring 1, 21, 41 less sensitive to climatic conditions.

Finally, in order to improve the chronometry of the resonator in which it is incorporated, balance-spring 1, 21, 41 may also include an inner coil $S_I$ having a Grossman type curve and a partially thickened outer coil.

What is claimed:

1. A balance-spring comprising:

a spiral spring formed of a strip wound on itself in several coils; and a collet including a strip extending substantially in the form of a triangle, the strip including, at each of the vertices of said triangle, a bulge extending radially towards the inner coil of the spring, the point of attachment between the spring and the collet being located on one of the bulges of said triangle which is symmetrical with respect to a staff passing through a center of the collet and said point of attachment, wherein the strip, between each of the vertices of said triangle, is formed of first and second extended areas of substantially constant widths and of a third area, between the first and second areas, which has a thickened width compared to those of the first and second areas, each of the third areas is arranged to contact the staff in order to shift the elastic deformation stresses on the first and second two areas, and wherein each of the third areas thicken as they extend radially towards the center of the collet, each thickened area includes a plane surface for a contact point with the staff.

2. The balance-spring according to claim 1, wherein the first and second areas have identical widths.

3. The balance-spring according to claim 1, wherein the length of the third area represents between 20% and 50% of the total length of the three areas.

4. The balance-spring according to claim 1, wherein the third area thickens as it extends radially towards the inner coil of the spring.

5. The balance-spring according to claim 1, wherein the third area thickens as it extends radially towards the center of the collet and towards the inner coil of the spring.

6. The balance-spring according to claim 1, wherein the balance spring is silicon-based.

7. A resonator for a timepiece, wherein the resonator comprises a staff onto which are fitted a balance and a balance-spring according to claim 1.

8. The balance-spring according to claim 1, wherein the width of the third area is substantially equal to 143% of the first and second areas.

* * * * *